US005747083A

United States Patent [19]

Raymond et al.

[11] Patent Number: 5,747,083

[45] Date of Patent: May 5, 1998

[54] DEVICE OF THE FEEDING-BOTTLE TYPE

[76] Inventors: Jean-Louis Raymond, 2, rue Chanzy, 66250 Saint-Laurent-de-la-Salanque; Jean-Luc Nierga, 2, rue Olivier-de-Serres, 66430 Bompas, both of France; Pedro Planas, Bjos Freixa, 39, 08021 Barcelona, Spain

[21] Appl. No.: 422,713

[22] Filed: Apr. 14, 1995

Related U.S. Application Data

[63] Continuation of Ser. No. 969,820, Jan. 21, 1993, abandoned.

[30] Foreign Application Priority Data

Jul. 20, 1990 [FR] France ..... 90 09549

[51] Int. Cl.[6] ..... A61J 9/00

[52] U.S. Cl. ..... 426/117; 215/11.3; 215/11.4; 215/11.5; 222/209; 426/115

[58] Field of Search ..... 426/117, 115; 215/11.1–11.5; 222/209

[56] References Cited

U.S. PATENT DOCUMENTS

| | | | |
|---|---|---|---|
| 1,732,126 | 10/1929 | Gardner | 215/11.5 |
| 1,827,100 | 10/1931 | Pardee | 215/11.5 |
| 2,001,842 | 5/1935 | Heise et al. | 215/11.1 |
| 2,043,186 | 6/1936 | O'Dette | 215/11.5 |
| 2,084,099 | 6/1937 | Maccoy | 215/11.5 |
| 2,219,604 | 10/1940 | Trotter | 222/207 |
| 2,321,236 | 6/1943 | Parkin | 215/11.5 |
| 2,442,656 | 6/1948 | Less | 215/11.4 |
| 2,624,485 | 1/1953 | Boston | 215/11.3 |
| 2,669,234 | 2/1954 | Baracate | 215/11.4 |
| 2,745,568 | 5/1956 | Newton | 215/11.4 |
| 2,747,573 | 5/1956 | Schaich | 215/11.4 |
| 2,772,817 | 12/1956 | Jauch | 222/207 |
| 2,803,251 | 8/1957 | White | 215/11.4 |
| 2,825,479 | 3/1958 | Litzie | 215/11.5 |
| 2,876,113 | 3/1959 | Barton | 215/11.3 |
| 2,876,772 | 3/1959 | Witz | 215/11.4 |
| 2,876,773 | 3/1959 | Witz | 215/11.4 |
| 2,907,485 | 10/1959 | Lunden | 215/11.1 |
| 2,979,078 | 4/1961 | Witz | 215/11.4 |
| 2,987,209 | 6/1961 | Leonard | 215/11.3 |
| 3,126,116 | 3/1964 | Clinehens | 215/11.1 |
| 3,134,494 | 5/1964 | Quinn | 215/11.3 |
| 3,207,349 | 9/1965 | Rabe | 215/11.1 |
| 3,411,648 | 11/1968 | Tichy | 215/11.4 |
| 3,424,157 | 1/1969 | Di Paolo | 215/11.4 |
| 3,481,500 | 12/1969 | Palmo | 215/11.3 |
| 3,593,871 | 7/1971 | Bundy | 215/11.3 |
| 3,651,973 | 3/1972 | Yamauchi | 215/11.3 |
| 3,704,803 | 12/1972 | Ponder | 215/11.4 |
| 4,135,513 | 1/1979 | Arisland | 215/11.4 |

(List continued on next page.)

FOREIGN PATENT DOCUMENTS

| | | | |
|---|---|---|---|
| 285744 | 7/1914 | Germany | 215/11.5 |
| 2083142 | 3/1982 | United Kingdom | 222/209 |
| 2226014 | 6/1990 | United Kingdom | 215/11.1 |

*Primary Examiner*—Steven Weinstein
*Attorney, Agent, or Firm*—Young & Basile, PC

[57] ABSTRACT

Device of the feeding-bottle type comprising: an external tubular body (1) having an open extremity (1*b*); a flexible capsule or container (3) housed or capable of being housed within said tubular body and presenting also an extremity (C) which is open or arranged to be opened; means(2, 42) allowing to communicate with environmental air, the space (D) existing between said flexible capsule (3) and the body (1); a specific teat (12) mounted or conformed to be mounted ahead of the openings (A, C) of said body (1) and said capsule (3); and an intermediary non-return valve (5) arranged between the open extremity (C) of said capsule (3) and the base of said teat (12) and delimiting with the latter a dispensing chamber (F); characterized in that a second valve (19, 20) is provided in the nipple piece (15) of the teat (12), between the dispensing chamber (F) and the outlet perforations (18) of said teat, said second valve (19–20) allowing the passage of nutrient liquid towards said outlet perforations (18) and opposing the entry of air into said dispensing chamber (F).

11 Claims, 8 Drawing Sheets

U.S. PATENT DOCUMENTS

| | | | |
|---|---|---|---|
| 4,339,046 | 7/1982 | Coen | 215/11.3 |
| 4,760,937 | 8/1988 | Evezich | 426/117 |
| 4,776,495 | 10/1988 | Vignot | 222/207 |
| 4,909,416 | 3/1990 | Evezich | 426/117 |
| 4,946,075 | 8/1990 | Lundback | 222/207 |
| 4,961,508 | 10/1990 | Weimer et al. | 222/207 |
| 5,035,340 | 7/1991 | Timmons | 215/11.4 |
| 5,101,991 | 4/1992 | Morifuji et al. | 215/11.5 |

DEVICE OF THE FEEDING-BOTTLE TYPE

This is a continuation of application Ser. No. 07/969,820, filed Jan. 21, 1993, now abandoned.

BACKGROUND OF THE INVENTION

1. Field of the Invention

The present invention relates to a device of the feeding-bottle type.

2. Brief Description of the Background of the Invention Including Prior Art

According to a particularly advantageous example of the invention, although non-limiting, the device according to the present invention is intended to provide a physiological feeding bottle which allows to feed a nursling in a way that reproduces the physical and mechanical processes of the breast feeding by requiring that the baby make sucking and pressure exertions having physiologically beneficent effects and suppressing all undesirable ingestion of air.

In fact, the feeding with a classical feeding bottle requires little or practically no effort from the nursling since the milk flows easily and almost naturally when said bottle is turned upside down while a volume of air penetrates into the teat and blends with the nutrient liquid, each time when the baby has to release its sucking such that the baby swallows a certain amount of air at the time of each sucking action which causes digestive problems for the baby. Furthermore, the conventional feeding bottles have a troublesome tendency to cause the baby to breathe through the mouth since the baby has to interrupt its sucking action in order to allow the air to enter into the teat.

Different devices of the feeding-bottle type have been proposed to facilitate or to regulate the discharge of the nutrient liquid (U.S. Pat. No. 1,441,623, U.S. Pat. No. 3,946,888) or to eliminate the ingestion of air (U.S. Pat. No. 4,339,046, U.S. Pat. No. 2,907,485) or aiming at obtaining both results at the same time (U.S. Pat. No. 4,339,046). Thus, there are known feeding bottles which comprise a specific teat associated with a check valve and having a flexible bag or capsule provided to contain the nutrient liquid and disposed in the body of the feeding bottle which includes, in addition, an entrance for air enabling the communication with the ambient air, with a space existing between said flexible bag and said body (U.S. Pat. No. 4,339,046). These feeding bottles, conceived to reduce the ingestion of air by the baby during the sucking, do not permit to reproduce the nursing conditions comparable to those of the breast feeding, such that they present the above mentioned inconveniences of the conventional feeding bottles.

The document U.S. Pat. No. 3,946,888 describes a device provided for reproducing the natural feeding conditions, where this device comprises a teat of variable thickness associated with a one-way check valve disposed between the bottle and the said teat. Nevertheless, it is obvious that such a device does not allow to obtain this objective because, on one hand, it operates by simple compression and release of the teat while, on the other hand, each time the baby releases the nipple, a quantity of air and a quantity of liquid enter both into said teat, where they are mixing together such that while the baby compresses again the latter, it ingests a certain quantity of air with the nutrient liquid contained in the bottle.

Another inconvenience of the classical feeding bottle and of the devices proposed for extenuating the shortcomings and inconveniences of these latter resides in the fact that, in order to function, they always have to be inclined in upside-down positions between the horizontal and the vertical.

SUMMARY OF THE INVENTION

1. Purposes of the Invention

In particular, the invention has the goal to remedy the above-mentioned imperfections of the conventional feeding bottles.

These and other objects and advantages of the present invention will become evident from the description which follows.

2. Brief Description of the Invention

According to the invention, this object is obtained thanks to a feeding bottle of the kind which comprises an external body or a tubular and deformable jacket including an open end. A flexible capsule or bag is disposed or capable of being disposed in this body and which includes also an open end, which is formed for being easily opened. A means is provided to allow the communication with the ambient air. A space exists between this flexible bag and this body. A specific nipple piece is mounted or is formed to be mounted in front of the openings of said body and of said bag. An intermediate check valve is disposed between the open end of said bag and the base of said teat and confining with this latter a dispensing chamber. This feeding bottle is remarkable because of the fact that a second check valve is fitted in the nipple piece of the teat between said dispensing chamber and the outlet perforations of said teat. This second check valve allows the passage of the nutrient liquid toward said outlet perforations and bars the entrance of air in direction of said dispensing chamber.

In an advantageous way, the nipple piece of the teat is formed in its interior such as to provide the seat of an axially movable valve. Said valve is joined to an elastic means which allows the axial motions of the valve and which is adapted to place the valve on its seat.

According to another embodiment characteristic of the invention, the valve is formed by a circular flange, where the upper part is formed by a core of an approximately conical shape disposed in an external deformable casing which provides the so-called teat. The base of this core presents a pleated, flexible and elastic skirt forming the means which allows the axial movements of the said valve and is adapted to place the valve onto its seat.

The physiological feeding bottle, according to the invention, allows to feed a nursling by making him perform an suckling effort analogous to that exerted on the teat of the mother's breast. In particular, this physiological feeding bottle allows the stimulation, by the pressing and propulsing effort of the temporomandibular joint which conditions in part the growth of the jaws and, in particular, the compensation for play of the retrognathic mandibular jaw of the newborn child. More generally, thanks to the formation of the muscular potential necessary for the three-dimensional bone growth, it contributes to the good maxillofacial development by thus preventing the appearance of dysmorphias and, later on, of certain dental malocclusions.

On the other hand, at the time of the feeding, the compensation air does not penetrate into the teat and does not blend with the liquid; in this manner, the nursling is not forced to release its sucking and cannot ingest air.

Another advantage of the device according to the invention is associated with the fact that it can operate in any position, including the not turned upside-down position, i.e. with the teat directed upwardly. Based on this fact, other applications of the invention can be foreseen.

For example, by way of performing a simple adaptation of the form and the dimensions of the device, one can foresee a use of the device for the feeding of adults, in specific environment (weightlessness or aqueous), in which the said device will behave normally, or when the hands or the attention are occupied in a continuous manner, or where one cannot drink of feed himself in the classical way (automotive sport, underwater diving, sailing sports or aerial sports etc.).

Another advantage of this device includes that it will not leak even in its upside-down position.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Reference is made to said drawings in order to describe an interesting exemplified embodiment, which is non-limitative, of the device of the kind of a feeding bottle, according to the invention which, according to this example, is formed by a physiological feeding bottle for the feeding of a nursling.

This feeding bottle comprises a tubular body 1 formed as an outer cylindrical container having a closed end 1*a* and an open end 1*b* defining a cylindrical container opening (A). The cylindrical container opening (A) is furnished with outer threads 28.

This body is preferably made of a semi-rigid material having an elastic deformation capability under the pressure of the hand of an adult. It can be made of any unbreakable synthetic material which has the required characteristics of rigidity and flexibility. The dimensions of the body can be identical or close to those of a traditional feeding bottle.

The body 1 includes, on the side, an opening B,in which a check valve 2 is installed, which is described in the following part of the present description. Opposite to the opening B and in proximity of its base 1*a*, the body 1 can include a concavity 1*c*, reproducing the form contained between the thumb and the forefinger. This ergonomic conformation allows to place the feeding bottle naturally in the desired and proper position.

A tubular flexible capsule or bag 3 containing or intended to contain the nutrient liquid is disposed or intended to be disposed in the body 1.

This bag assumes a general cylindrical form and includes a closed end and an end which is furnished with a large opening C or a flexible bag opening and with a mounting flange 3*a* which allows the positioning of the bag and assures the impermeability. The volume of the cap can be provided in order to practically fill the body 1, where a reduced space D is furnished preferably between the bag and said body.

In order to be able to use the total of the content of the bag and to avoid a deformation of the capsule, which could provoke the formation of retention pockets, an axial rib (increase in thickness) is provided.

This bag 3 can be:

reusable;

single use; item that can be discarded after use;

ready for use.

The bag 3 can be made entirely of elastomer having the required air tightness and flexibility qualities which allow its crushing without effort, where the elastomer can be advantageously translucent.

If the flexible bag 3 is furnished to be reusable, its basic material has to be sufficiently strong and resistant in order to endure the successive washings and sterilizations said bag is destined to be subjected to. Moreover, such reusable bag can carry on a side a scale which allows the measurement of the nutrient liquid.

When one uses these flexible, reusable and translucent bags, then the preparation of the nutrient liquid (milk or other preparation) is carried out in a traditional way.

Figure 7:
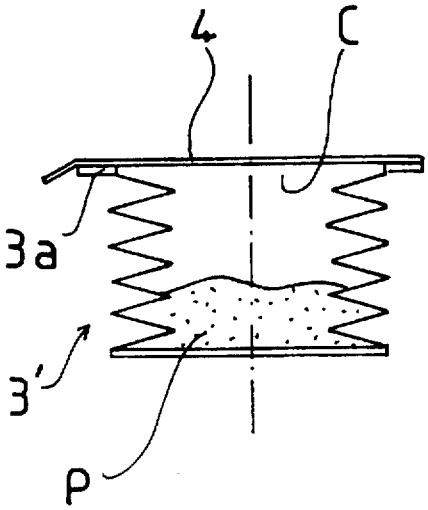
FIG. 7 is a sectional axial view of a flexible bag furnished for a unique use and containing a dehydrated nutritive preparation.
Figure 9:
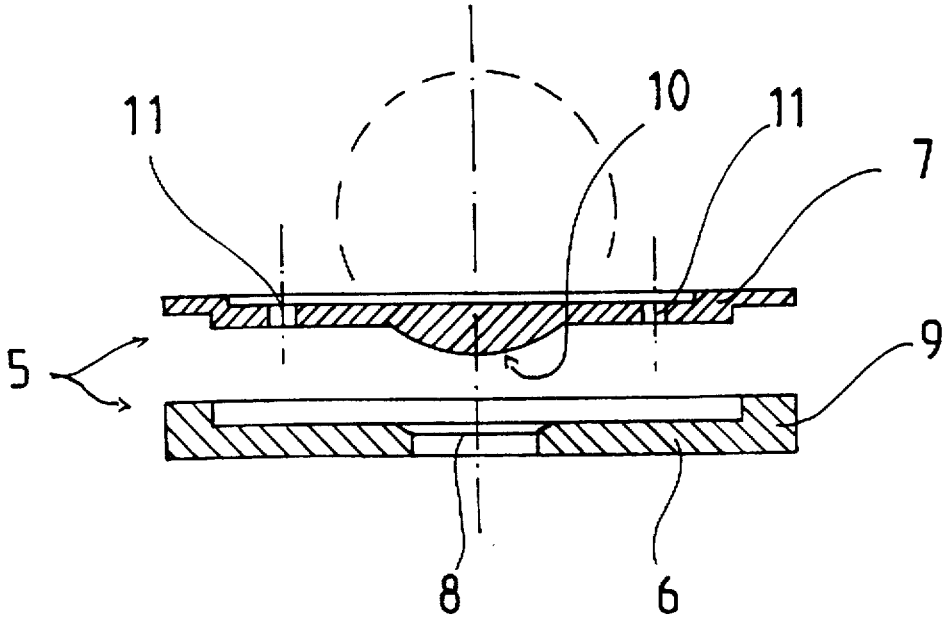
FIG. 9 is an exploded and sectional axial view of the intermediate check valve.

When the bag 3' is provided for a single use, it can contain a dehydrated and premeasured nutrient preparation P, packed under vacuum in the said bag, and which presents itself in a flattened shape and where its opening C is closed by a detachable cover lid 4, which is fixed on its flange 3*a*, as shown in FIG. 7.

When the lid cover is withdrawn, the bag relaxes under the effect of an intake of the air and allows to add the necessary water for the fluidification of the preparation.

This type of flexible bags 3' can be proposed with different capacities and with different dehydrated or freeze-dried nutrient preparations.

This solution brings an improvement of the hygiene of the preparations, a great ease of use and allows storing the preparations in a minimum space.

Figure 8:
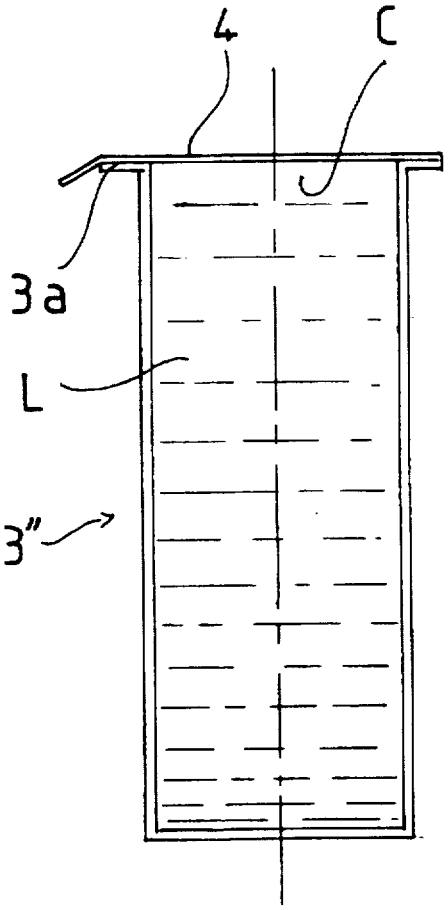
FIG. 8 is a sectional axial view of a bag ready for use.

If the bag 3" is ready for use, it contains a certain quantity of nutrient liquid L for which it is dimensioned and its upper opening C is also closed by a detachable cover lid 4 (FIG. 8), where the nutrient preparation is ready to be ingested by the nursling.

A one-way check valve or an intermediate check valve 5 is disposed in front of the opening C of the bag 3 and the check valve 5 is formed by two circular membranes 6, 7 where one is applied against the other.

The lower membrane 6 is placed in front of the opening C of the bag 3 and is made of a rigid, non-deformable material (for example a rigid plastic material) and it comprises in its center a circular hole 8 of a spherical configuration. It is provided on its upper face with a peripheral shoulder 9 which allows the centering and the embedding of the upper membrane 7 into the delimited seat by said shoulder.

The upper membrane 7 is made of a flexible rubber or another flexible and elastic, easily deformable synthetic elastomer. The upper membrane 7 comprises in its center, a hump 10 of spherical configuration which is oriented in the direction of the hole 8 of the lower membrane 6. Bores 11 are disposed at a distance of its center part occupied by said hump.

The teat 12 is composed of an outer hollow casing 13 which forms the so-called teat and of an inner core 14 disposed in the said teat.

The outer casing 13 takes the shape of a traditional teat, i.e. it includes a nipple piece 15 furnished with perforations 18 and a body 16 in the shape of a bulb where the open base is furnished with connecting and sealing flange 17. The outer casing 13 is made of a flexible material which has an elasticity and a sufficient rigidity to return to its normal shape when the effort of crushing, to which it is subjected, disappears. It is emphasized that the return force of the outer casing to its initial shape is designed to cause a suction effect of a force suitable for disengaging the upper membrane 7 from the lower membrane 6.

The nipple piece 15 of the teat is formed on its inside such as to furnish a valve seat. This valve seat is formed by a narrowing or an inner annular rib 19, formed by the casing 13 at the level of the attachment of the nipple piece 15 to the body 16.

The narrowing 19 serves as seat to a valve 20 which is axially movable, this valve is advantageously formed by a circular flange which presents the end part of the core 14 oriented in the direction of the nipple piece 15 of the teat. This valve has, preferably, a toric shape and its seat has a concave profile with a spherical configuration.

Naturally, the flange 20 which forms the valve has a diameter larger than the diameter of the passage E delimited by the narrowing 19 serving as seat to said valve; nevertheless, the diametrical difference is relatively reduced, in a way to allow at the same time, a good sealing against the entrance of air into the teat and an easy separation of the casing 13 and of the core 14 for their cleaning.

The core 14 takes a substantially conical form with a lightly concave lateral surface. It comprises a solid portion which is running from its top close to the base, which includes two recesses 21, where each of them communicates with a hole 22. The recesses 21 allow, on one hand, the passage of the nutrient liquid and, on the other hand, an easy grip of the core 14 in order to extract it from the casing 13, for example, in order to facilitate the cleaning of the latter.

The base of the core 14 comprises a flexible and pleated skirt 23, which is furnished with a capability of elastic deformation and which is joined to the connection and sealing flange 24; this flexible and pleated skirt 23 allows the axial movements of the core 14 and, consequently, of the valve 20. On the other hand, the elasticity of this skirt 23 allows to obtain a residual closing force which tends to apply the valve 20 onto its seat 19.

Figure 10:
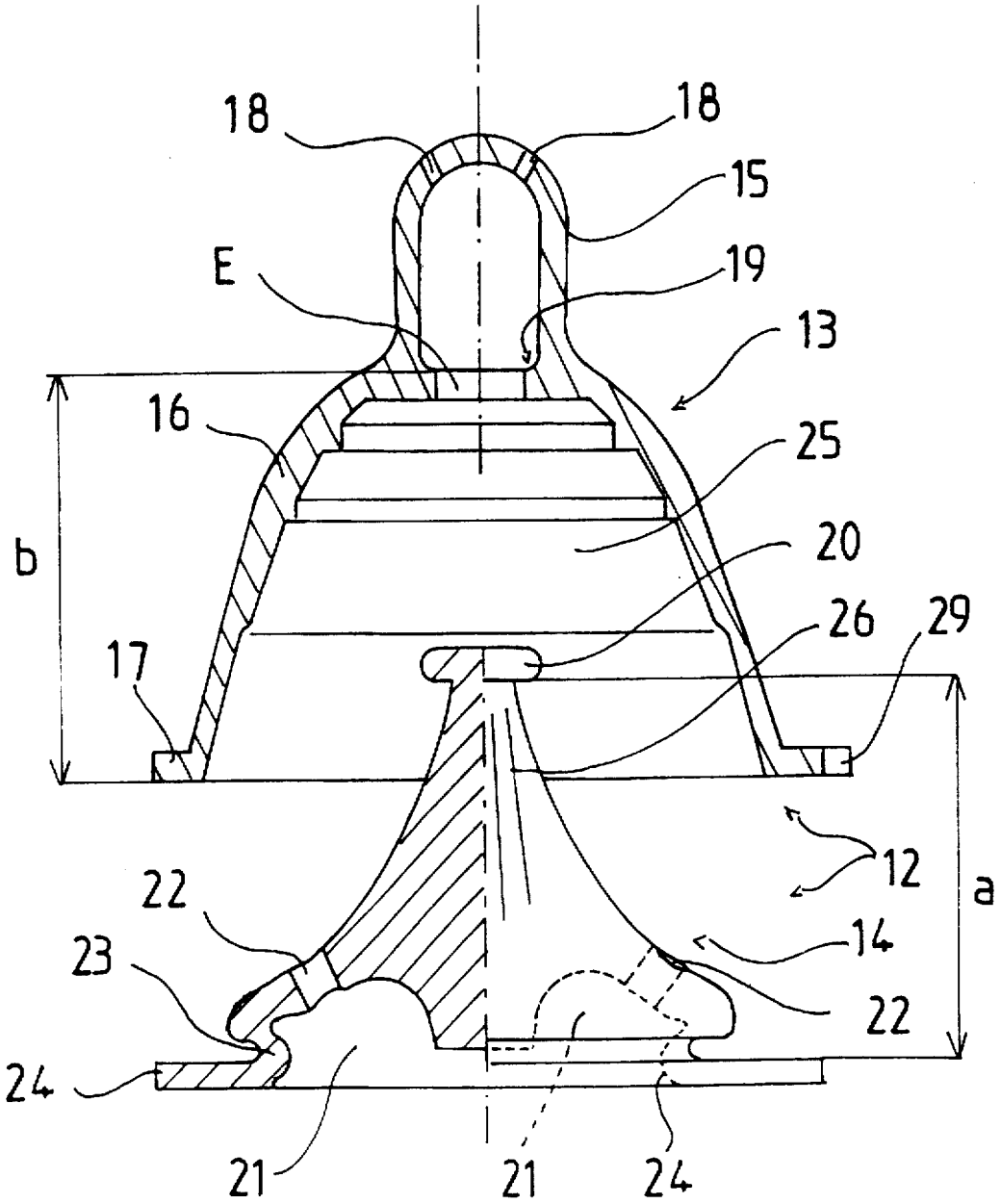
FIG. 10 is an exploded, sectional axial and enlarged view of the teat.

It is emphasized that, at rest, the distance "a", present between the base of the valve 20 and the lower face of the flange 24 of the core 14, is smaller than the distance "b" present between the seating surface of the seat 19 and the lower face of the flange 17 of the casing 13 (FIG. 10), which allows to obtain an initial load of the said valve.

The base thus equipped with the core 14 assures the axial guidance of the valve, while, other than the fact that they allow the passage of the nutrient liquid, the holes 22 assure the equilibrium of the pressures in the teat.

The lateral surface of the core 14 is furnished with longitudinal furrows 26 which allow the passage of milk or other nutrient liquid in the case of a crushing of the casing 13.

Figure 5:
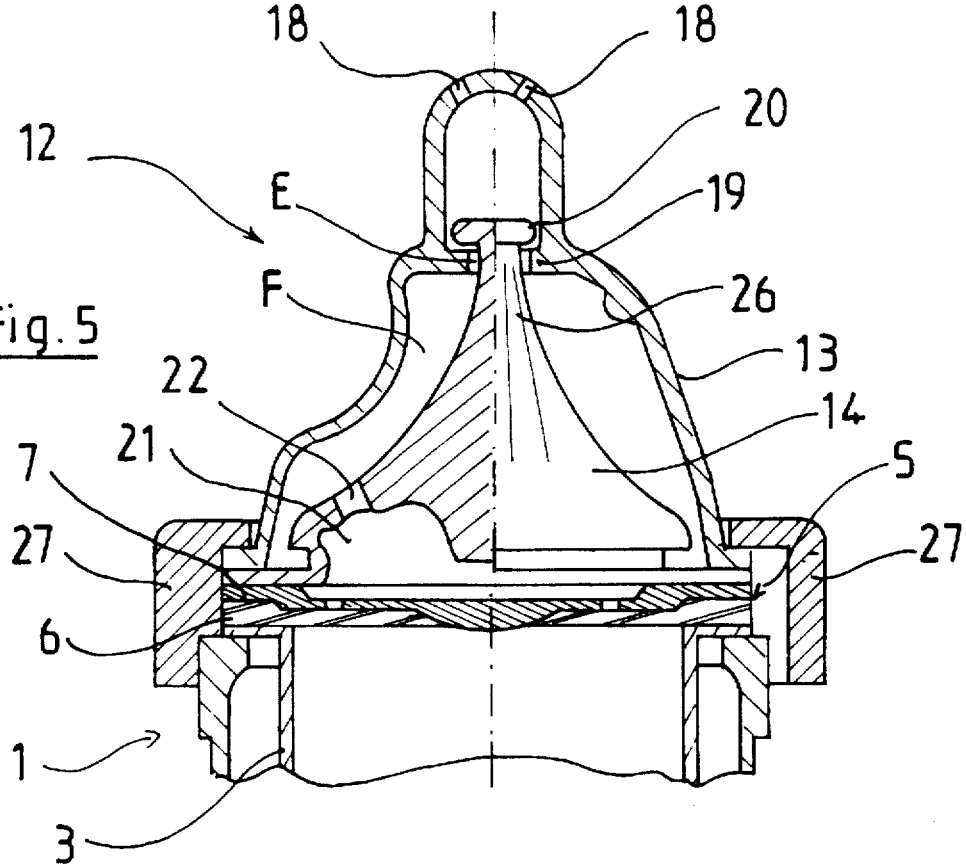
FIGS. 5 and 6 are partial views, at an enlarged scale, corresponding respectively to FIGS. 3 and 4.
Figure 6:
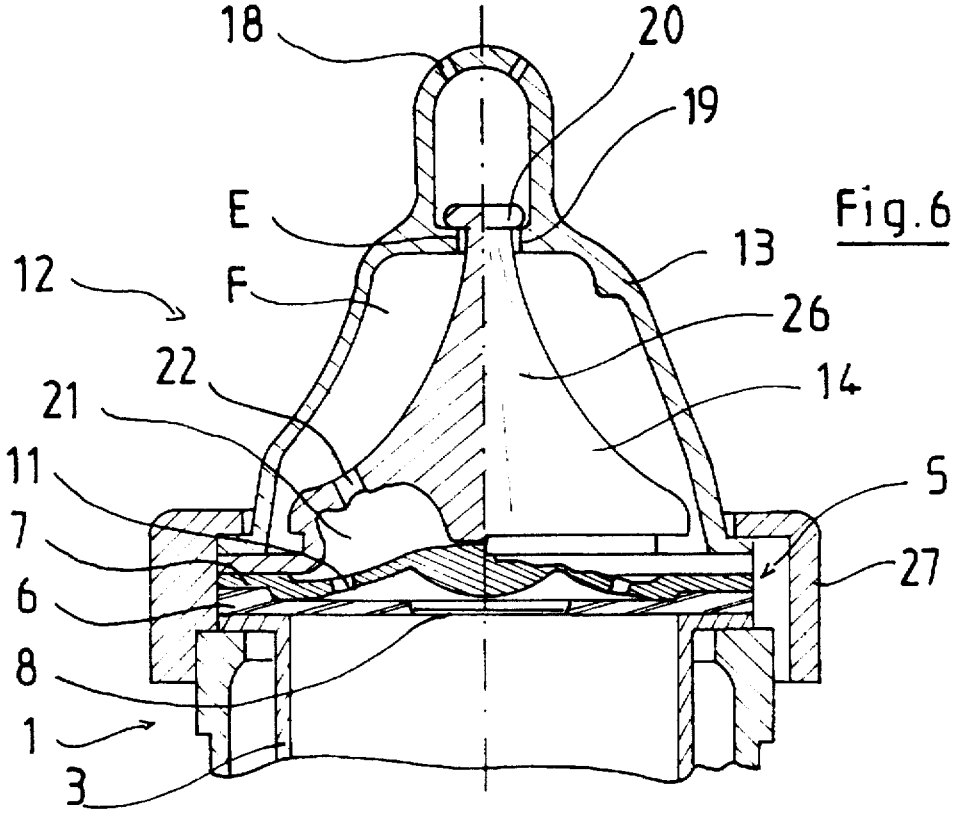

When the different essential elements of the feeding bottle are assembled, the check valve 19–20, the intermediate check valve 5, and the casing 13 define a dispensing chamber F. The core 14 is placed in the interior of said dispensing chamber and has a longitudinal movement capability of reduced amplitude. On the other hand, at rest, a slight space is provided between the base of the core 14 of the teat and the flexible membrane 7 of the intermediate check valve (FIG. 5), in order to allow the lifting up of this latter when the chamber F is in a state of negative pressure (FIG. 6).

The sealing assembly of the different essential elements described above of the feeding bottle is obtained by means of a clamping ring 27 of a classic, conventional concept which is fastened by screwing onto the open end of the body 1, furnished with an additional outer threading 28, preferably by means of a "quarter turn" system, which allows an easy and fast closing of said feeding bottle while avoiding an excessive tightening which could cause a deterioration of the sealing elements during adjustment.

This clamping ring assures also the positioning turn of the teat 12 relative to the body 1 of the feeding bottle.

For this purpose, the side wall of the ring 27 includes, for example, inwardly, a longitudinal groove **27*a*, into which a stop 29 can engage where the flange 17 of the casing 13 is furnished on the periphery of the stop 29**.

Figure 13:
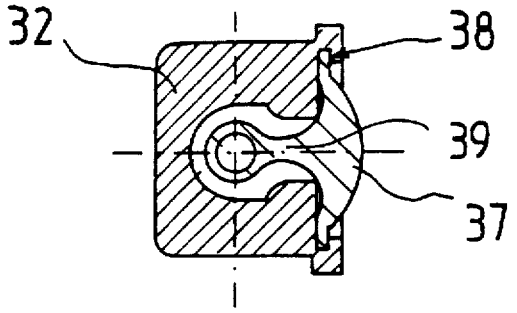
FIG. 13 is a cross-sectional view along the section line 13—13 of FIG. 11.
Figure 12:
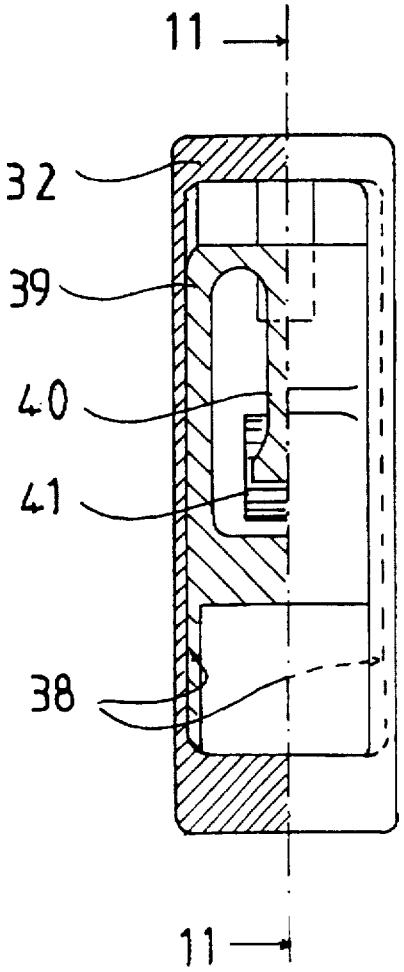
FIG. 12 is a front and half sectional view along section line 12—12 of FIG. 11.
Figure 11:
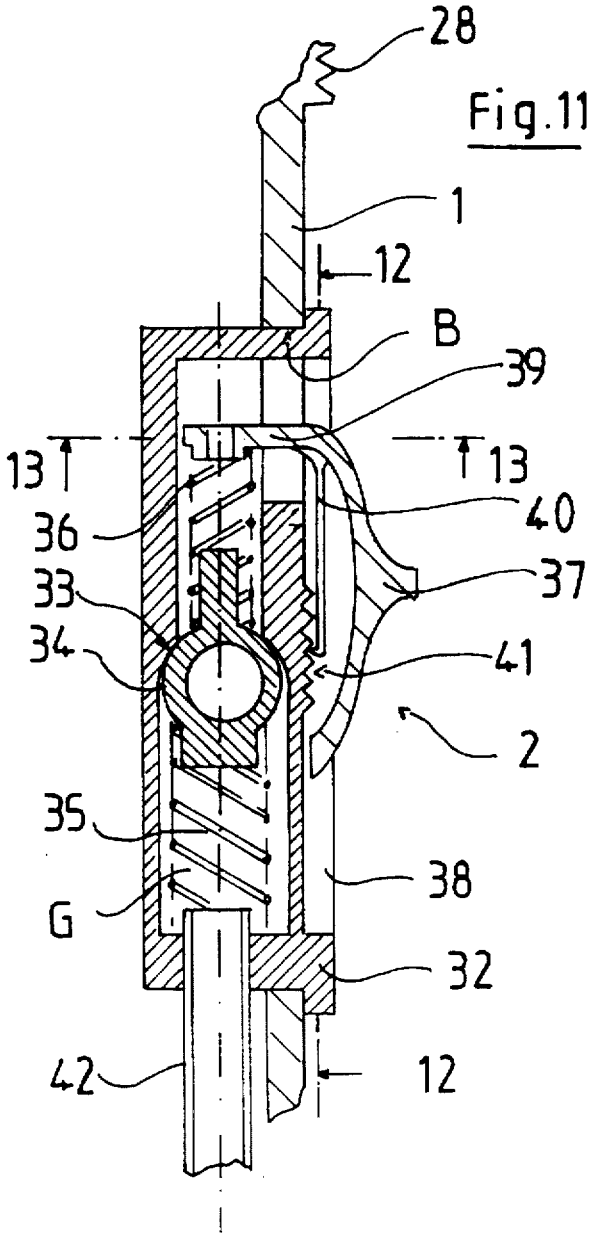
FIG. 11 is a sectional axial view along the section line 11—11 of FIG. 12.

The FIGS. 11 to 13 illustrate valve means or ventilation means formed as the check valve 2 installed in the body and assuring the entrance of compensation air between said body and the deformable bag 3 placed in this latter.

The check valve 2 comprises a housing 32 installed fixedly in the opening B of the body 1, near the open end, furnished with the threading 28, of the latter body 1. This housing includes inwardly a constriction 33 formed to serve as seat of an axially movable stopper plug 34, which is submitted to the pressure of a spring 35 tending to apply it against its seat 33. This spring 35 is clamped, on one hand, against said stopper plug and, on the other hand, against the bottom of the housing 32.

The check valve 2 is adjustable to be able to control the general output of the feeding bottle and the negative pressure necessary for the outflow of the liquid. Furthermore, a calibration of the check valves allows to maintain a negative pressure in the interior of the feeding bottle.

The adjustment device of the check valve 2 comprises a spring 36 wedged by means of one of its ends against the stopper plug 34, and exerting onto the latter an action counter to that of the spring 35. The springs 35 and 36 are preferably of the helical type acting as compression and they are placed in alignment, where the control spring 36 is less stiff than the restoring spring 35 of the stopper plug.

A control button 37 is mounted with a capability of longitudinal displacement in a sliding channel 38, furnished in the outer face of the housing 32, and allows to control the calibration of the spring 36 and, consequently, of the check valve 2. This control button includes, on one hand, a finger 39 resting against the upper end of the spring 36 and, on the other hand, a notched rod 40 cooperating with a rack 41 provided in front of the housing 32 and allowing to immobilize said control button in the desired position.

It is understood that the more the control spring 36 is compressed, the more its pressure rises and compensates the pressure of the restoring spring 35 onto the stopper plug 34. In this manner, the opening threshold of the check valve is lowered.

It is emphasized that the characteristics of the control spring 36 have to be such that, when this spring is brought into maximum compression, the stopper plug 34 has still to undergo a slight pressure of the restoring spring 35 so that said stopper plug 34 can fulfill its function of non-return check valve.

For ease of execution, the housing 34 of the check valve 2 can be formed of two parts and can be installed in the opening B of the body 1 after mounting the different essential elements and assembling of said parts.

According to preferred way, the adjustable check valve 2 is placed at the entrance of a conduit leading to and opening near the bottom 1*a* of the body 1.

According to the operating method described, the chamber G delimited by the stopper plug 34 communicates in the interior of the housing 32 with a plunger tube 42 which extends in a downward direction to near the bottom la of the body 1. This tube allows the entrance of compensation air in the bottom of the body 1 of the feeding bottle.

It also assures safety and hygiene of the operation in case of rupture of the bag 3.

In fact, in the position of use, the level of the spilled liquid pouring accidentally into the body 1, is disposed below the exit of the plunger tube 42 and, based on this fact, it cannot penetrate into the said tube and into the check valve.

On the other hand, in transport position, the liquid cannot climb up through the plunger tube.

This construction is interesting because, if some nutrient liquid were to penetrate into the check valve, the check valve would be damaged by the dry deposits which would be harmful to the hygiene and the good functioning of the unit.

Figure 1:
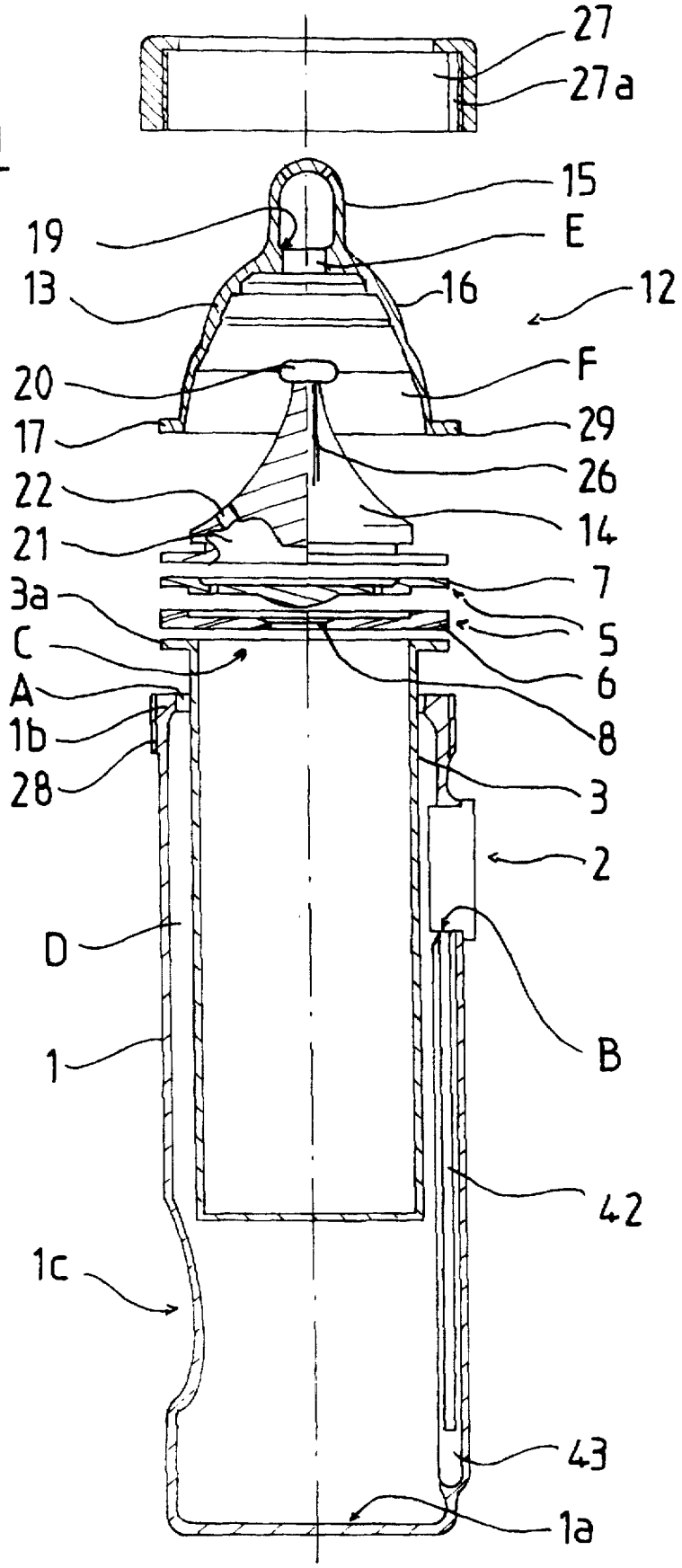
FIG. 1 is an exploded and a sectional axial of a physiological feeding bottle provided according to the invention.
Figure 2:
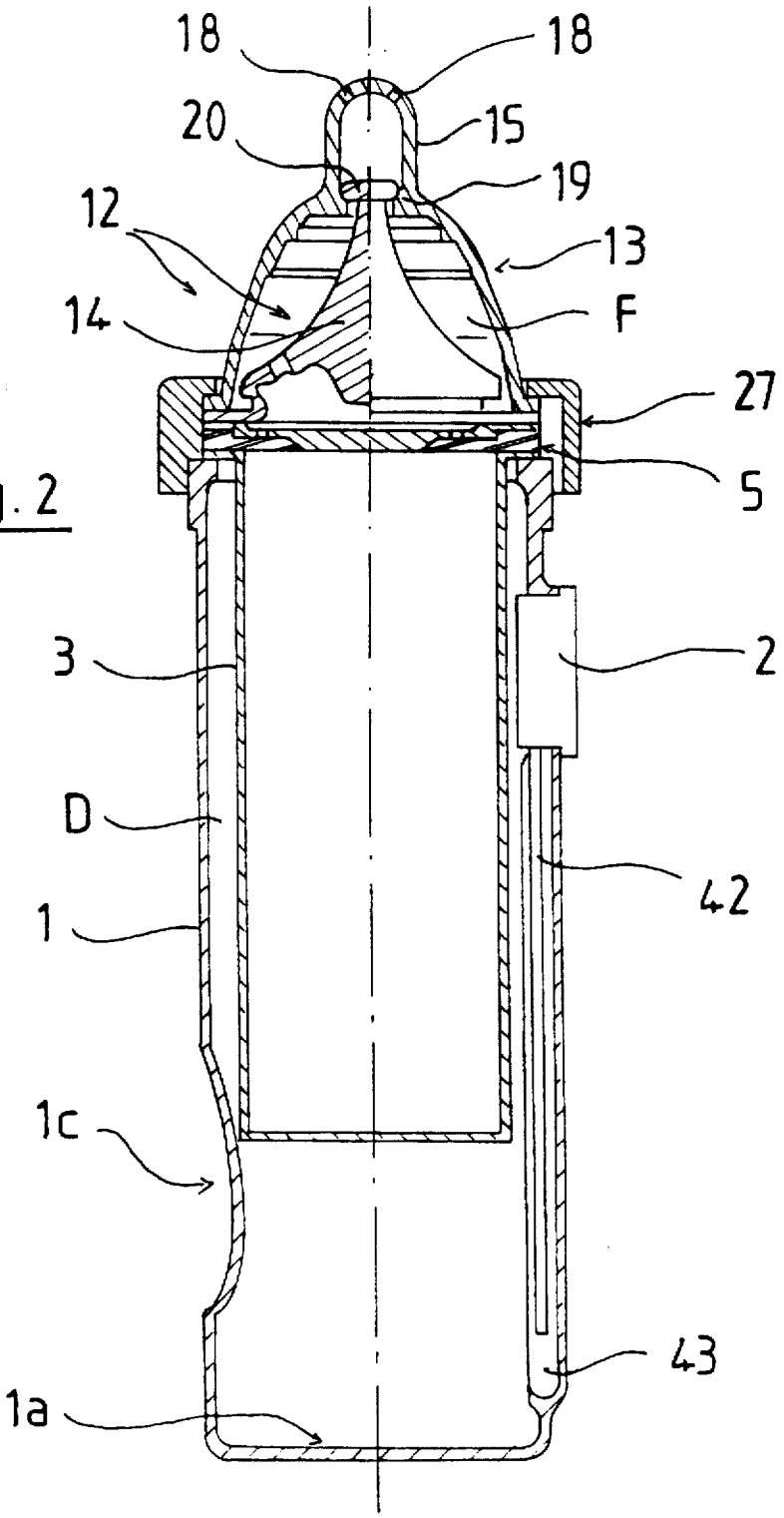
FIG. 2 is a sectional axial view of this feeding bottle.

Furthermore, it prevents that the bag 3 not impede the entrance of compensating air into the space D, since the exit of the plunger tube 42 opens below said cap (FIG. 2).

The plunger tube is preferably positioned in a longitudinal channel 43 furnished in the body 1 and corresponding to an outer rib of the latter, such as it does not find itself jutting out, into the inner space delimited by said body.

Different operation phases of the feeding bottle according to the invention are described below:

1. Purging

Before the feeding, the essential elements of the feeding bottle are assembled, a manual crushing of the body 1 has the effect of compressing the air present in the space D between the bag 3, containing the nutrient liquid, and said body; while the check valve 2 is closed, the bag 3 is crushed and the air contained in the bag 3 escapes at the nipple piece through the check valves 5 and 19–20 and, more exactly, at the passage 8-11-21-22-F-E-18. When the body 1 is released, the pressures reverse, the check valves 19–20 and 5 close, the check valve 2 opens and the air penetrates between said body 1 and the bag 3.

Several successive pressures onto the body 1 allow thus to expel the air possibly contained in the bag 3 and in the teat 12.

2. Temperature test:

When the feeding bottle is purged, a supplementary pressure causes the liquid to squirt and allows to check the temperature.

3. Suction:

In the case of a feeding by suction, the negative pressure exercised by the child opens the check valve 19–20, then the check valve 6–7, and the liquid can flow out through the passage 8-11-21-22-F-E-18, by bringing about the progressive crushing of the bag 3 and the entrance of the compensation air into the space D, through the check valve 2 and the plunger tube 42.

4. Pressuring

Figure 3:
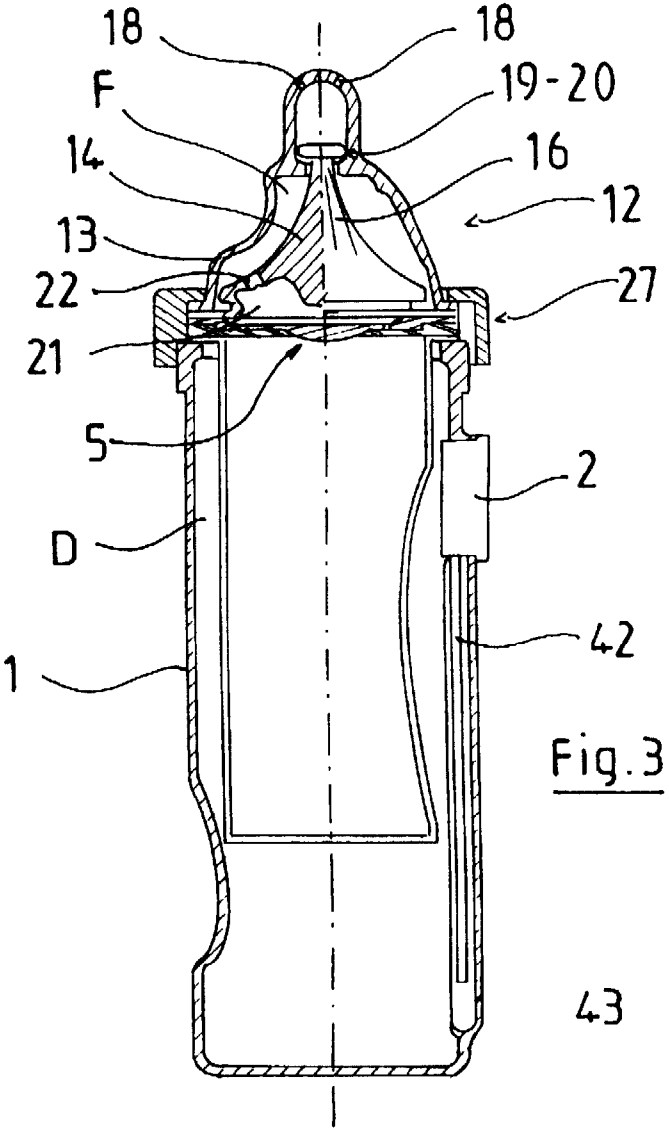
FIGS. 3 and 4 are sectional axial views illustrating the functioning of the feeding bottle.

The crushing of the casing 13 of the teat 12 by the jaws of the newborn generates an overpressure in the interior of same, i.e. in the chamber F. This overpressure has the effect, on one hand, of maintaining the check valve 6–7 in a closed position and, on the other hand, of assuring the opening of the check valve 19-20 and the outflow of the liquid contained in the teat through the perforations 18 (FIGS. 3 and 5).

Figure 4:
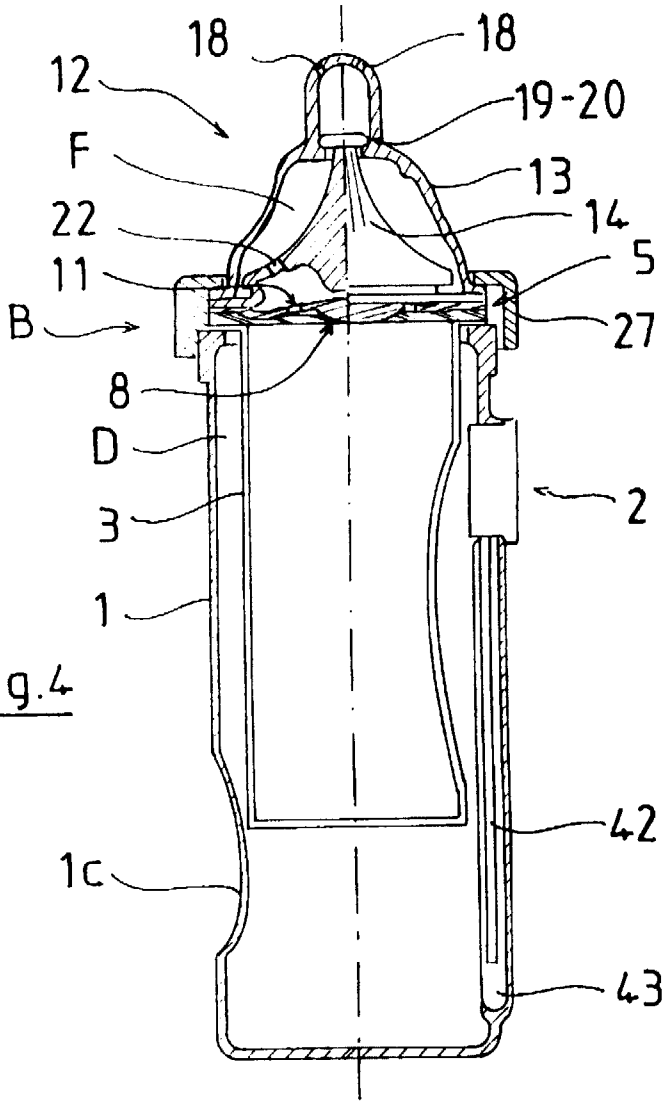

At the time of the relaxing of the jaws, the interior (chamber F) of the teat is subjected to a negative pressure, the check valve 19–20 closes such that the air cannot penetrate into the chamber F, the check valve 6–7 opens, the milk is suctioned into the teat and fills said chamber, the compensation air penetrates into the space D through the check valve 2 and the plunger tube 42 (FIGS. 4 and 6).

While the invention has been illustrated and described as embodied in the context of a device of the baby's feeding-bottle type, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is ser forth in the appended claims.

We claim:

1. A device of the feeding-bottle type, comprising:

an outer tubular body having a closed end and an open end, and a body opening disposed at the open end;

a flexible bag having a closed end and a bag opening, the flexible bag disposable in the outer tubular body and, when placed in the outer tubular body, forming a space between the outer tubular body and the flexible bag;

means, on the outer tubular body, for admitting ambient air into the space between the outer tubular body and the flexible bag as the contents of the flexible bag are discharged;

a teat including a base disposed at a first end, a nipple with outlet perforations disposed at an opposite end, and an outer deformable casing extending between the nipple and the base, the teat being disposed in front of the outer tubular body and in front of the bag opening;

an intermediate non-return check valve, disposed between the bag opening and the base of the teat defining a dispensing chamber together with the outer deformable casing of the teat, for allowing one way flow of liquid from the bag into the dispensing chamber;

a core disposed within the dispensing chamber and having a base disposed adjacent to the intermediate check valve and a conical shape extending to a second end;

at least one aperture formed in the core and establishing a fluid flow path between the flexible bag and the dispensing chamber through the intermediate check valve; and a second check valve integral with the second end of the core, the second check valve disposed in the nipple between the dispensing chamber and the outlet perforations of the nipple, wherein the second check valve allows a passage of liquid toward the outlet perforations, and opposes an entrance of air into the dispensing chamber;

the second check valve being seated in a narrowing of the nipple, the narrowing forming a seat for the second check valve; and elastic means, carried by the core, for allowing movement of the second check valve in a direction between the base and the nipple and tending to seat the second check valve on the narrowing of the nipple.

2. The device of the feeding-bottle type, according to claim 1 wherein the elastic means comprises a pleated, flexible, elastic skirt formed on the core adjacent to the base which allows movement of the second check valve in a direction between nipple and base and which pleated, flexible and elastic skirt tends to seat the second check valve onto the narrowing of the nipple.

3. The device of the feeding-bottle type according to claim 1 wherein an outer surface of the conical portion of the core has at least one longitudinal furrow.

4. The device of the feeding-bottle type according to claim 1, wherein the intermediate non-return check valve comprises:

a first membrane disposed in front of the bag opening, the first membrane being rigid and having a center aperture;

a second membrane applied against the first membrane, the second membrane being deformable and carrying at its center a hump oriented in a direction of the aperture for disengageable seating in the aperture of the first membrane; and at least one bore formed in the second membrane and fluid communicatible with the aperture in the core.

5. The device of the feeding-bottle type according to claim 1 further comprising:

a space between the base of the core and second membrane allowing flexure of the second membrane away from the first membrane under negative pressure in the dispensing chamber to separate the hump from the aperture in first membrane and to establish a liquid flow path from the bag to the dispensing chamber through the aperture in the first membrane, the at least one bore in the second membrane and the aperture in the core.

6. The device of the feeding-bottle type according to claim 1, wherein the means for admitting air into the space, comprises a third check valve installed in a lateral opening of the outer tubular body and disposed at an entrance of a conduit leading to and opening near a bottom of the outer tubular body.

7. The device of the feeding-bottle type according to claim 6, wherein the third check valve is adjustable, the third check valve comprising:

a plunger seat;

a restoring spring;

a valve plunger, movable in a direction perpendicular to a plane of the plunger seat and subjected to a force of the restoring spring tending to apply the valve plunger against the plunger seat;

a second spring exerting a spring force onto the third check valve opposite to the force of the restoring spring;

a movable control button allowing a compression of the second spring, and means for stopping the movable control button in a desired position.

8. The device of the feeding-bottle type, according to claim 1, wherein the outer tubular body is made of a material which is sufficiently flexible and elastic to undergo a slight manual crushing and being capable of recovering to its initial shape;

wherein the flexible bag contains a nutrient preparation ready to use; and wherein the flexible bag is closable in an impervious manner by means of a detachable cover lid.

9. The device of the feeding-bottle type, according to claim 1, wherein the flexible bag contains a nutrient preparation in a dehydrated form, and wherein the flexible bag is closable in an impervious manner by means of a detachable cover lid.

10. The device of the feeding-bottle type, according to claim 1, wherein the flexible bag contains a nutrient preparation in a freeze-dried form, and wherein the flexible bag is closable in an impervious manner by means of a detachable cover lid.

11. A device of the feeding-bottle type according to claim 1, wherein:

the intermediate non-return check valve, and the second check valve are located relative to the outer tubular body, the flexible bag, and the teat such that, when the teat is mounted on the outer tubular body containing the flexible bag and a liquid therein, and a consumer sucks on the nipple, a negative pressure caused by the sucking of the nipple opens the second check valve and then the intermediate non-return check valve enabling flow of the liquid through the valves and the nipple by bringing about a progressive crushing of the flexible bag and an entrance of compensating air into the space in the outer tubular body and such that, when the teat is crushed by the jaws of the consumer, an overpressure is generated in the teat, which maintains the intermediate non-return check valve in a closed position and opens the second check valve enabling an outflow of the liquid contained in the teat through the outlet perforations in the nipple, and such that, at the time of relaxing the jaws, the interior of the teat is subjected to a negative pressure, the second check valve closes such that air cannot penetrate into the interior of the teat, the intermediate non-return check valve opens, and the liquid is suctioned into the teat and fills the interior of the teat while the teat returns to its original shape and compensation air penetrates into the space between the outer tubular body and the flexible bag.

* * * * *